US006568760B2

(12) United States Patent
Davis et al.

(10) Patent No.: US 6,568,760 B2
(45) Date of Patent: May 27, 2003

(54) CHAIR OF MODULAR CONSTRUCTION

(75) Inventors: Keith L. Davis, Wilton, IA (US); Marcus C. Koepke, Indianapolis, IN (US); Jamie Krull, Coralville, IA (US); Jay R. Machael, Muscatine, IA (US); Matthew J. Phillips, Muscatine, IA (US); Douglas A. Schroeder, Muscatine, IA (US); Craig H. Schultz, Muscatine, IA (US); Erik A. Steffensen, Iowa City, IA (US); Brian R. Trego, Muscatine, IA (US); Eric M. Zillig, Muscatine, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 09/881,897

(22) Filed: Jun. 15, 2001

(65) Prior Publication Data

US 2002/0190563 A1 Dec. 19, 2002

(51) Int. Cl.[7] ..... A47C 7/00

(52) U.S. Cl. ..... 297/440.14; 297/440.15; 297/440.2; 297/300.1; 297/300.2; 297/301.1

(58) Field of Search ..... 297/440.14, 440.1, 297/440.15, 440.16, 440.2, 300.1, 300.2, 301.1

(56) References Cited

U.S. PATENT DOCUMENTS 518,097 A * 4/1894 Derby ..... 297/440.15
3,907,363 A * 9/1975 Baker et al. ..... 297/440.2 X
3,982,785 A * 9/1976 Ambasz ..... 297/440.14 X
4,099,774 A * 7/1978 Sandham ..... 497/400.2 X
4,169,625 A * 10/1979 Petersen ..... 297/440.2 X
4,318,570 A * 3/1982 Adam et al. ..... 297/440.1 X
4,521,053 A * 6/1985 De Boer ..... 297/440.2 X
4,979,778 A * 12/1990 Shields ..... 297/300.2
5,249,839 A * 10/1993 Faiks et al. ..... 297/300.1
5,295,731 A * 3/1994 Dauphin ..... 297/440.16
5,318,346 A * 6/1994 Roosien et al. ..... 297/300.1
5,630,643 A * 5/1997 Scholten et al. .... 297/440.15 X
5,662,381 A * 9/1997 Roosien et al. ..... 297/440.2 X
5,782,536 A * 7/1998 Heidmann et al. ..... 297/440.15
5,810,439 A * 9/1998 Roslund, Jr. ..... 297/300.2 X
5,826,940 A * 10/1998 Hodgdon ..... 297/300.1 X
5,873,634 A 2/1999 Heidmann et al. ..... 297/440.14
5,979,988 A 11/1999 Heidmann et al. ..... 297/440.14
6,062,649 A * 5/2000 Nagel et al. ..... 297/440.2 X
6,161,897 A * 12/2000 Kurtz et al. ..... 297/300.2 X
6,224,160 B1 * 5/2001 Takeuchi et al. ..... 297/440.15
6,367,876 B2 * 4/2002 Caruso et al. ..... 297/300.2
6,382,723 B1 * 5/2002 Piretti ..... 297/300.1

* cited by examiner

*Primary Examiner*—Peter R. Brown
*Assistant Examiner*—Rodney B. White
(74) *Attorney, Agent, or Firm*—Jones Day

(57) ABSTRACT

A chair of modular construction having modules that form the basic chair with additional modules that can be added to the chair without changing the basic construction thereof.

15 Claims, 12 Drawing Sheets

CHAIR OF MODULAR CONSTRUCTION

BACKGROUND OF THE INVENTION

1. Field of the Invention

The present invention relates in general to a chair and in particular to a chair that is of modular construction and which can be constructed economically and some modules added as needed.

2. Description of Related Art Including Information Disclosed Under 37 C.F.R. §§1.97 and 1.98

There exists in the art a multitude of different chair constructions, each being designed as a single or unitary body that does not allow for addition of modular units as desired. Furthermore, these chairs are all very complicated in their construction.

It would be advantageous to have a chair that is constructed in modules in a simple and easy manner and to which additional modules such as arm rest modules, back rest tilt modules, a lumbar support module, and a chair height modules could be added as desired.

SUMMARY OF THE INVENTION

The present invention relates to a chair of modular construction that has a central base module, first and second seat and back support module connected to the central base module, a seat plate module being mounted over the top of the central base module for receiving a chair seat, a back rest frame module attached to the seat and back support module and to the seat plate module for receiving a back rest, a wheel base module coupled to the bottom of the central base module for providing mobility to the chair, a lumbar support module for supporting the lumbar region of the user of the chair, a seat back tilt control module associated with the seat plate module, and a seat height adjustment module associated with the base module with a lever arm attached to the seat plate module for actuating the seat height adjustment module.

The arm rest module may or may not be attached to the chair if desired without affecting the construction of the chair as it exists. In like manner, the lumbar support module may or may not be coupled to the back rest frame support module. Further, the seat back tilt control mechanism can be omitted without changing the construction of the basic chair.

Thus, it is an object of the present invention to provide a chair of modular construction wherein some modules can be omitted without changing the basic construction of the chair.

It is another object of the present invention to provide a chair of modular construction that is simple and easy to construct.

It is yet another object of the present invention to provide a chair of modular construction in which a central base module forms the hub of the chair and to which elongated seat and back support modules can be added, a seat plate module can be added, a back rest frame module can be added and a wheel base module can be added.

It is still another object of the invention to provide a chair of modular construction using a central base module to which can be added arm rest modules, lumbar support modules, and seat tilt control modules as needed without changing the design of the chair.

Thus, the invention relates to a novel chair of modular construction comprising a central base module having a top and a bottom and opposing ends; a seat plate module having a front end and a rear end and being attached to the top of the central base module for receiving a chair seat; first and second elongated seat and back support modules, each having a front end and rear end, and each being rigidly attached to a respective end of the central base module for supporting a seat plate and a back support; a seat plate module having a front end and a rear end and being mounted over the top of the central base module for receiving a chair seat; a back rest frame module attached to the seat and back support module and to the seat plate module for receiving a back rest; and a wheel base module coupled to the bottom of the central base module for providing mobility to the chair.

If desired, the invention further comprises a lumbar support module for coupling to the back rest frame module for supporting the lumbar region of a user of the chair, as well as a seat tilt module that can be associated with the seat plate module and having a lever arm attached to the tilt control mechanism for adjusting the tilt of the seat back module.

BRIEF DESCRIPTION OF THE DRAWINGS

These and other objects of the present invention will be more fully disclosed when taken in conjunction with the following detailed description of the drawings in which like numerals represent like elements and wherein.

DETAILED DESCRIPTION OF THE PREFERRED EMBODIMENT(S)

Figure 1:
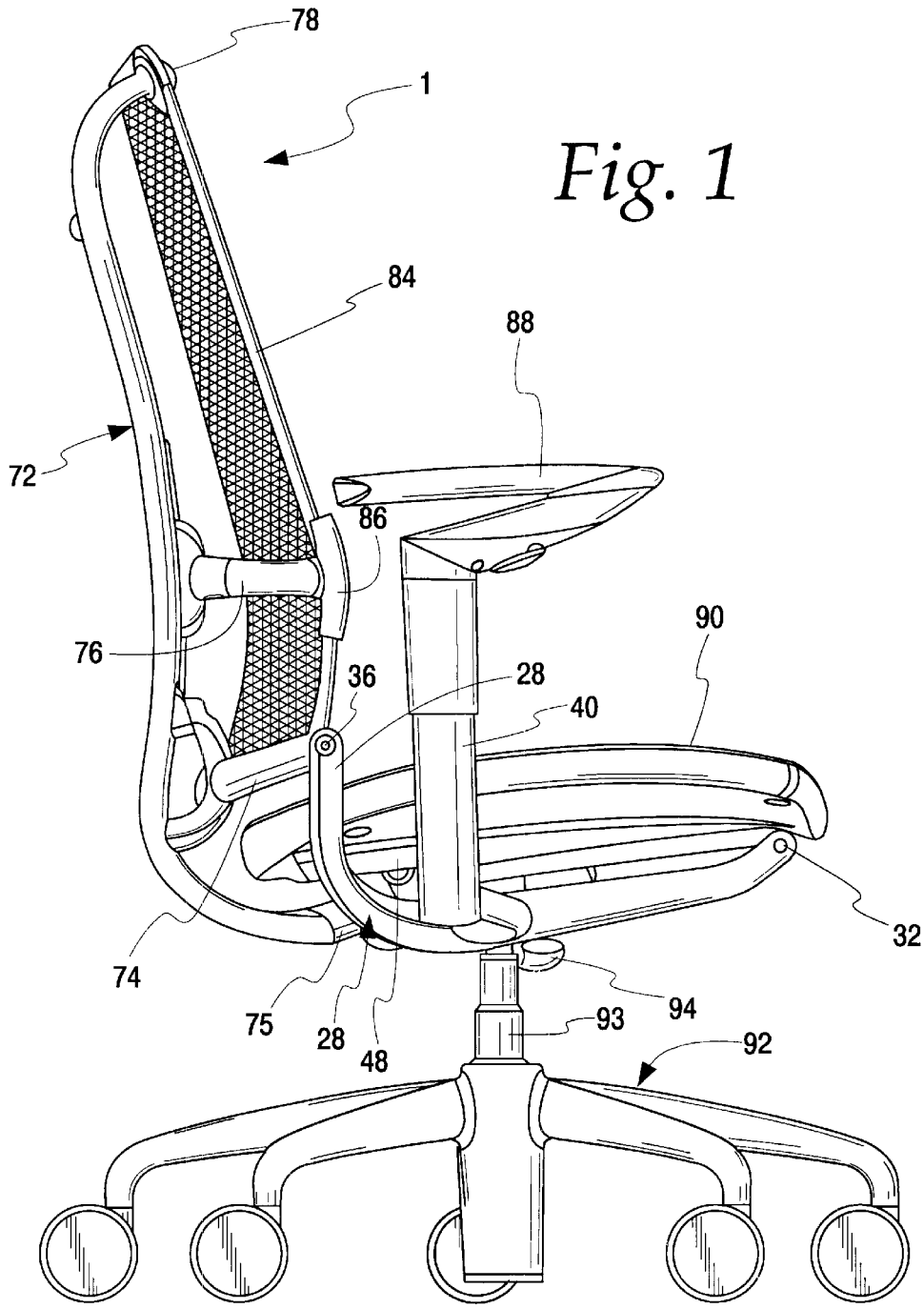
FIG. 1 is a side view of the novel chair of modular construction.

FIG. 1 is a side view of the novel chair 1 that is formed of modular construction. It has a central base module 10, best shown in FIGS. 2 and 3, with first and second elongated seat and back support frame modules 28 and 30 (see FIG. 4), each having a front end portion 32, 34 and a rear end portion 36, 38 and each being rigidly attached to an end portion 16, 18 of the central base module 10 for supporting a seat plate module 48 and a back rest frame module 72. The seat plate module 48 (best shown in FIGS. 8, 9 and 10) has a front end portion 50 and a rear end portion 55 and is mounted over a top portion 12 of the central base module 10 for receiving a chair seat 90. The back rest frame module 72 is attached to the seat and back support frame modules 28 and 30 and to the seat plate 48 and receives a back rest 84. A wheel base module 92 is coupled to the bottom of the central base module 10 for providing mobility to the chair.

Figure 2:
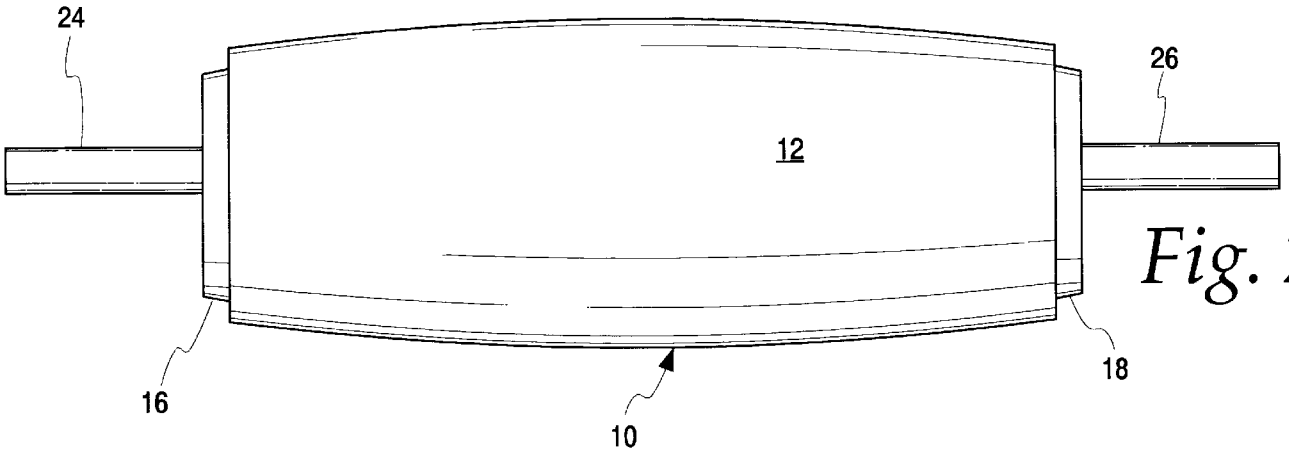
FIG. 2 is a top view of the central base module.

FIG. 2 is a top view of the central base module 10. It has mounting rods 24, 26 extending from each end of the central base module 10. These mounting rods 24, 26 form a support for attaching the elongated seat and back support frame modules 28 and 30 and extend beyond the elongated seat and back support frame modules 28 and 30 as shown in FIG. 4 to enable support of the first and second arm rest modules 40, 42, FIG. 6, attached thereto.

Figure 3:
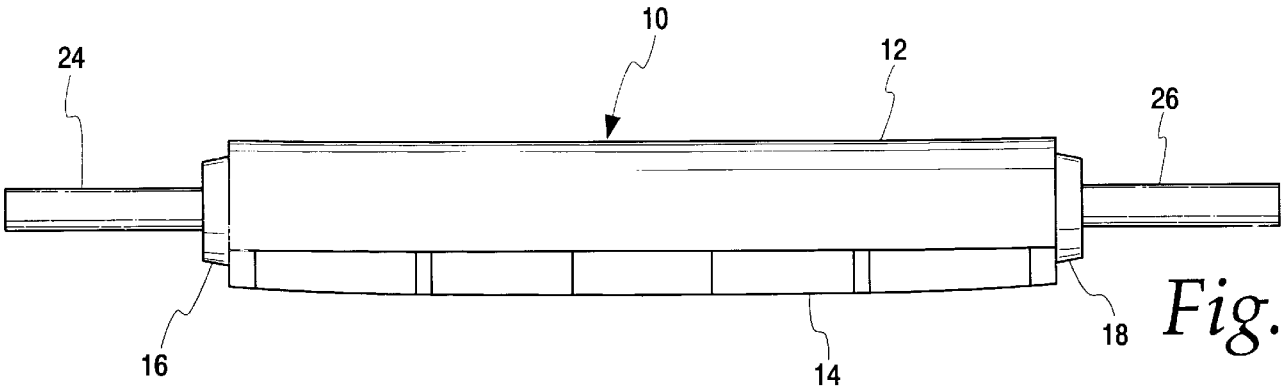
FIG. 3 is a front view of the central base module.

FIG. 3 is a front view of the central base module 10 illustrating the top portion 12 and a bottom portion 14 thereof as well as the opposing end portions 16 and 18 and the rods 24 and 26 extending from each central module end portion.

Figure 4:
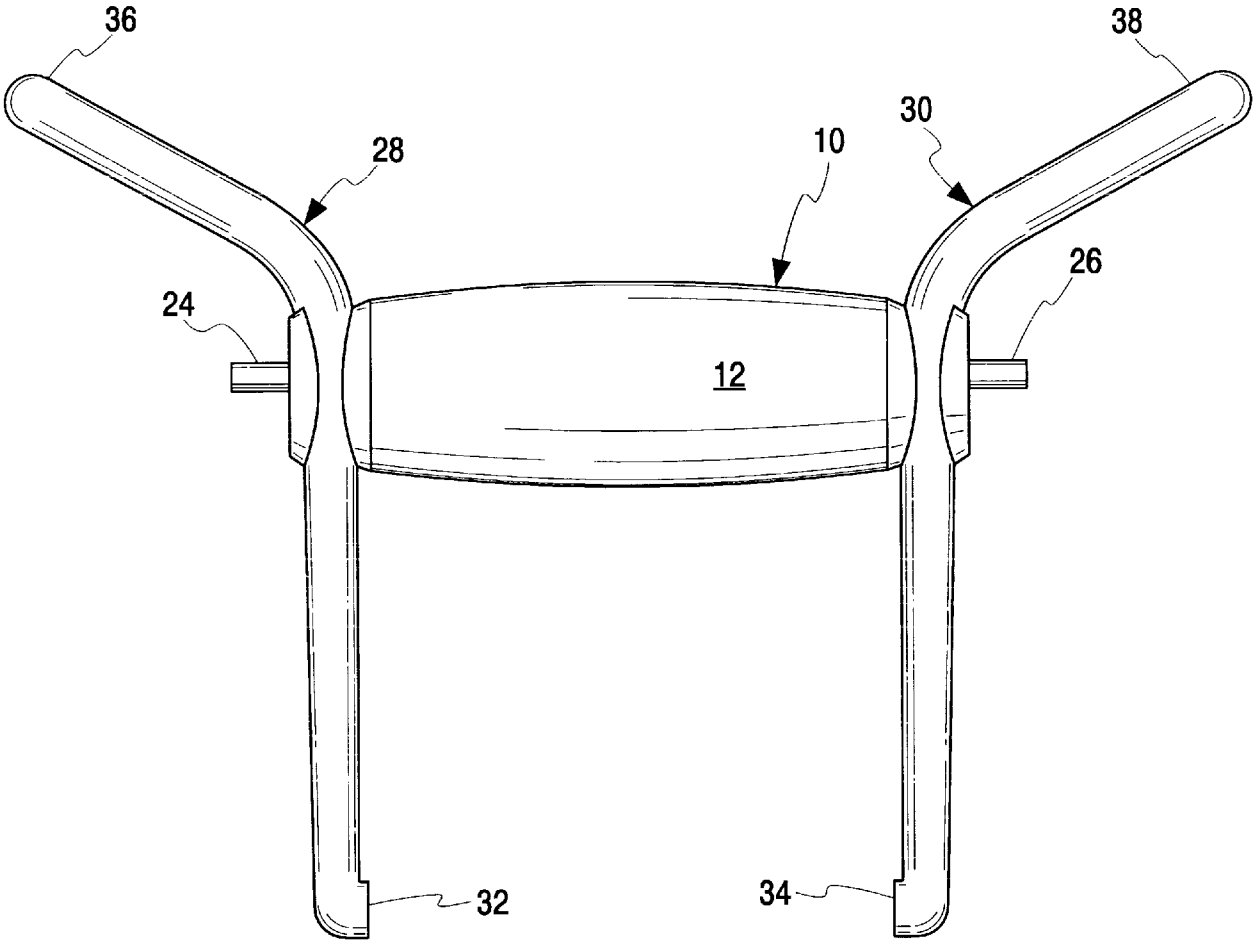
FIG. 4 is a top view of the central base module having added to it first and second elongated seat and back support modules.

FIG. 4 illustrates the central base module 10 having the first and second elongated seat and back support frame modules 28 and 30 attached thereto. It will be noted that the first elongated seat and back support frame module 28 has the front end portion 32 and the rear end portion 36, while the second elongated seat and back support frame module 30 has the front end portion 34 and the rear end portion 38.

Figure 5:
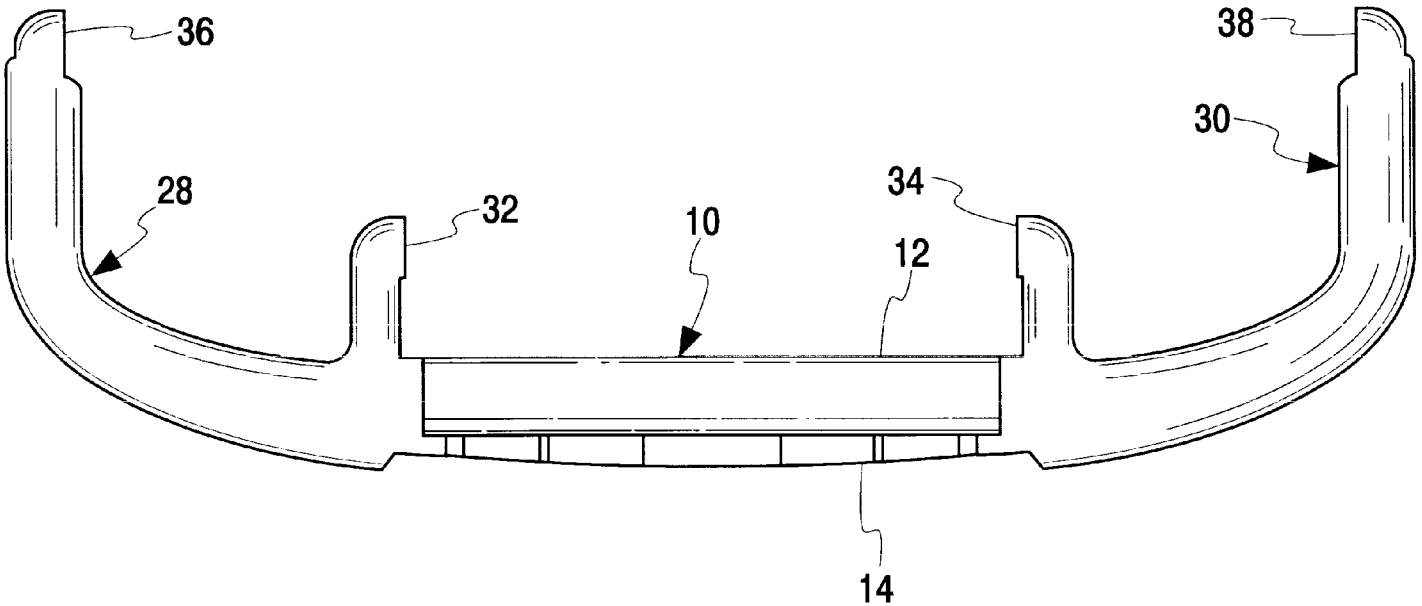
FIG. 5 is a front view of the modules shown in FIG. 4.

FIG. 5 is a front view of the central base module 10 having the first and second elongated seat and back support frame modules 28 and 30 attached thereto as shown in FIG. 4.

Figure 6:
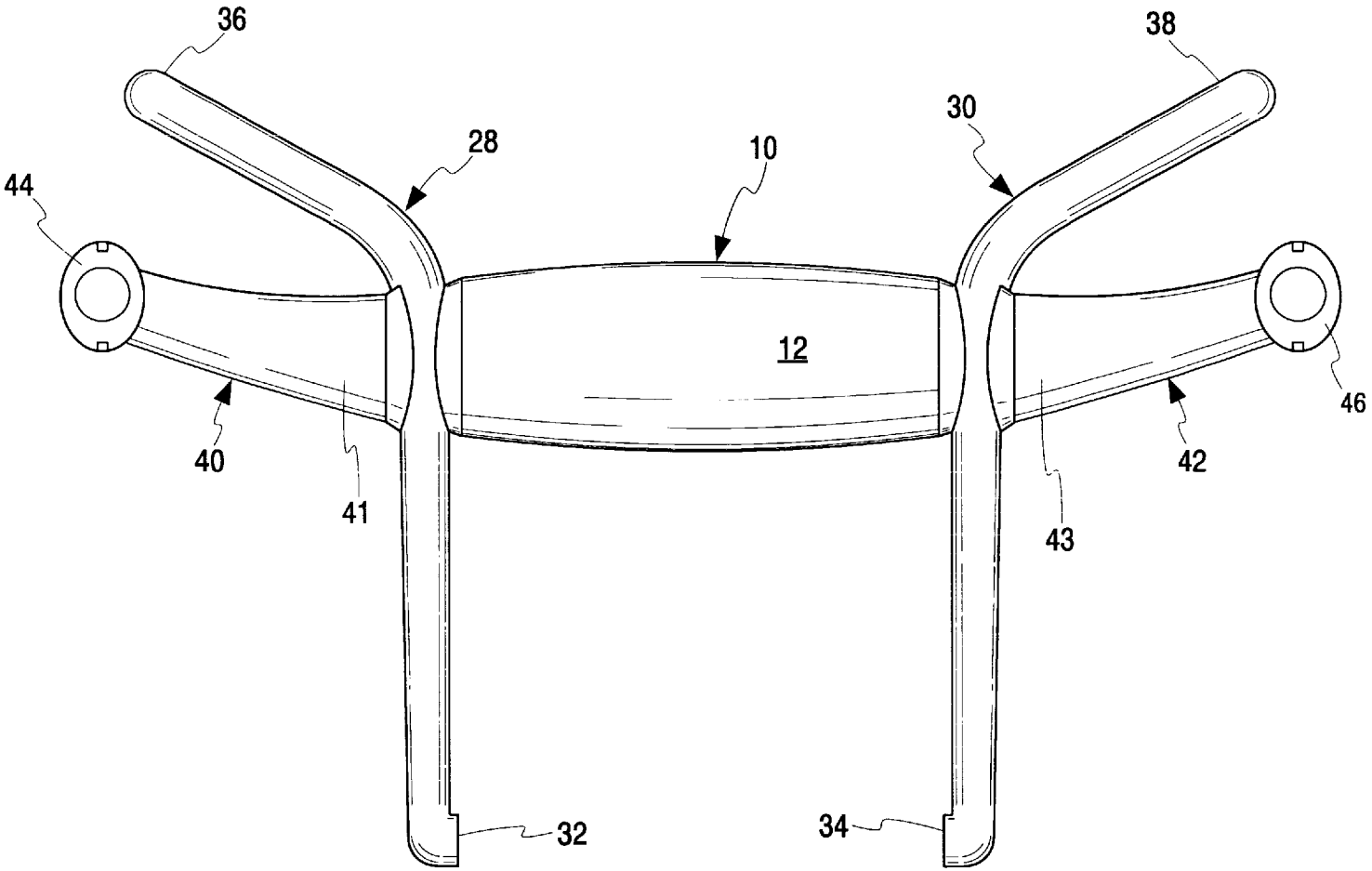
FIG. 6 is a top view of the central base module having the first and second elongated seat and back support modules and having further added first and second arm rest modules.

FIG. 6 is a top view of the combined modules of FIG. 4 to which have been added the arm rest modules 40 and 42. Each of the arm rest modules is mounted on the rods 24, 26 that extend from each end of the first and second elongated seat and back support frame modules 28 and 30 and are attached to the first and second elongated seat and back support frame modules 28 and 30 in any normal way such as by the use of bolts. The arm rest modules 40 and 42 have upper ends 44 and 46 to which arm rests may be attached.

Figure 7:
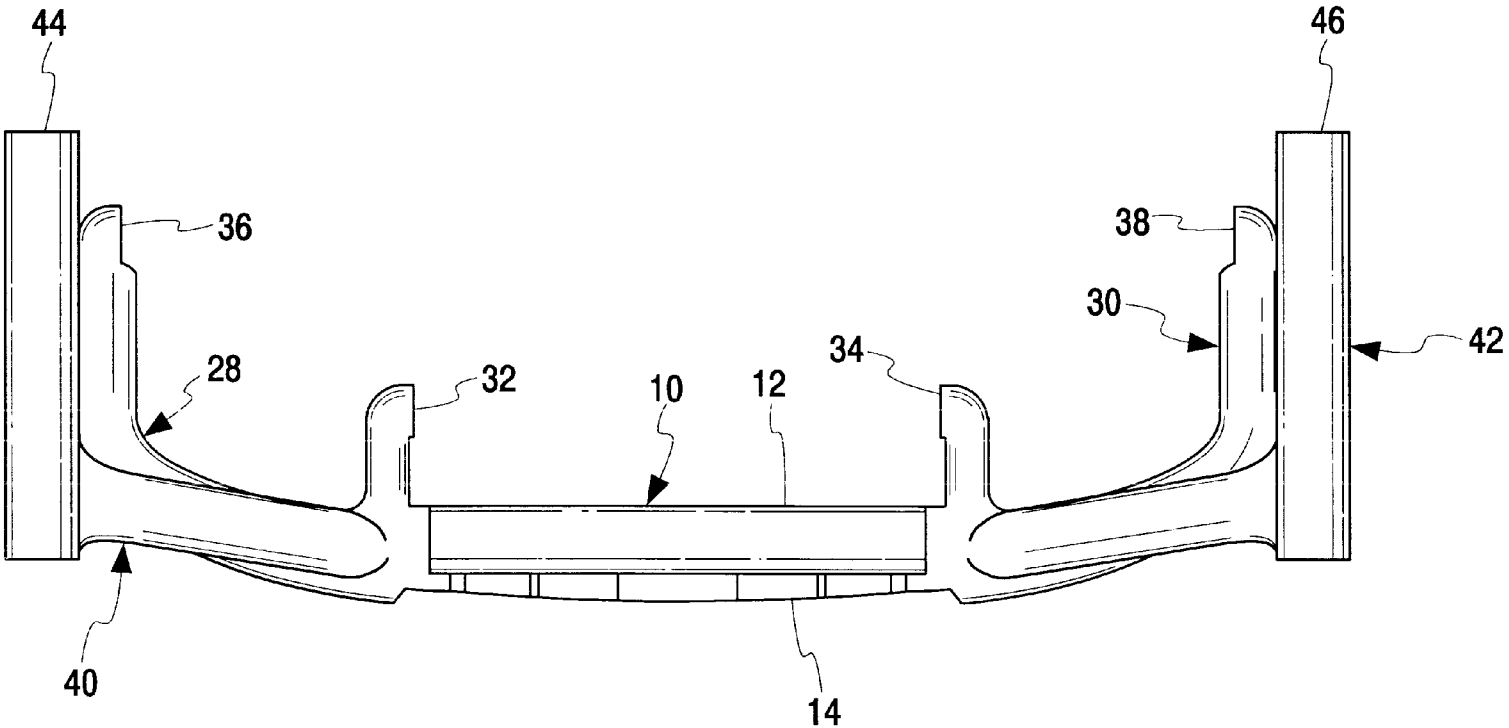
FIG. 7 is a front view of the modules illustrated in FIG. 6.

FIG. 7 is a front view of the combined modules of FIG. 6 showing the arm rest modules 40 and 42 mounted on the outside of the first and second elongated seat and back support frame modules 28 and 30 which are in turn mounted on the central base module 10.

Figure 8:
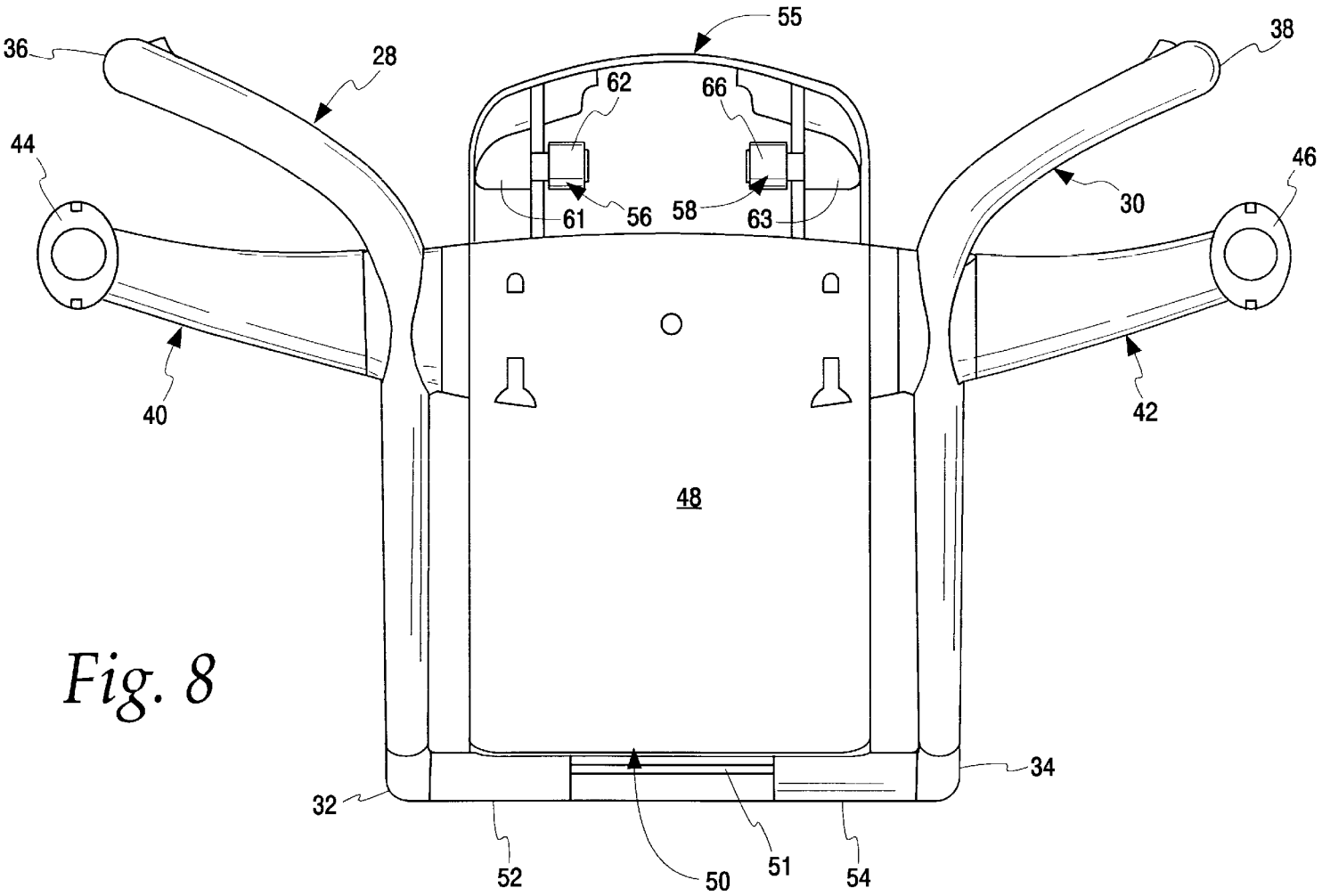
FIG. 8 is a top view of the combined modules of FIG. 6 having a seat plate module mounted over the top of the central base module for receiving a seat.

FIG. 8 is a top view of the modules shown in FIG. 6 to which a seat plate module 48 has been added. The seat plate module 48 has the front end portion 50 and the rear end portion 55 and is mounted over the top portion 12 of the central base module 10 for receiving the chair seat 90 as illustrated in FIG. 1. Any well known attachment means, such as a bolt 51, may be used to couple the front end portion 50 of the seat plate 48 to the front end portions 32, 34 of the elongated seat and back support frame modules 28, 30. The rear end portion 55 of the seat plate 48 connects to pivot links 56 and 58, the lower ends of which are attached to the seat plate 48 and the upper ends of which are attached to a lower pivot bar of the back rest frame module which will be discussed in more detail hereafter.

Figure 9:
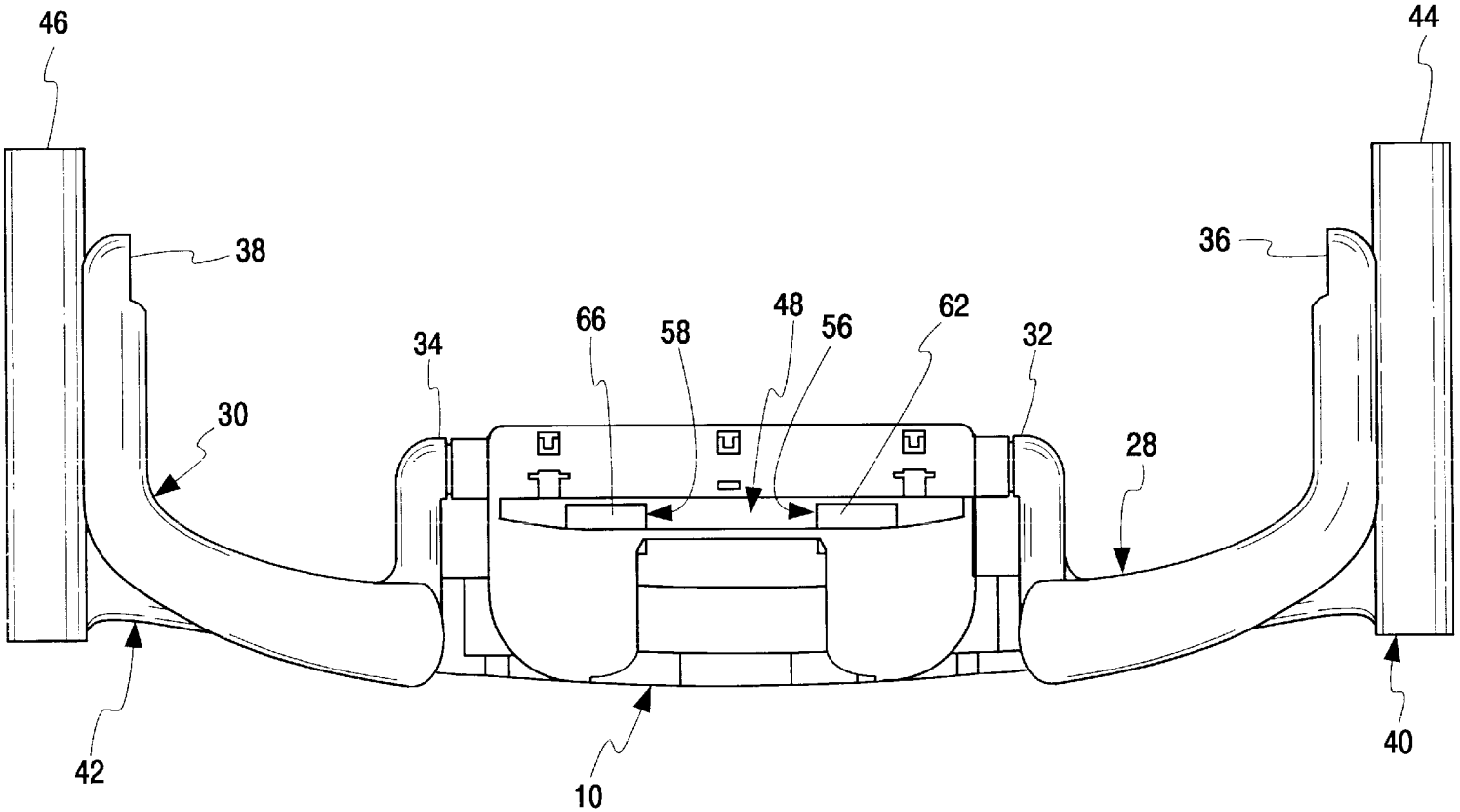
FIG. 9 is a rear view of the combined modules illustrated in FIG. 8.
Figure 10:
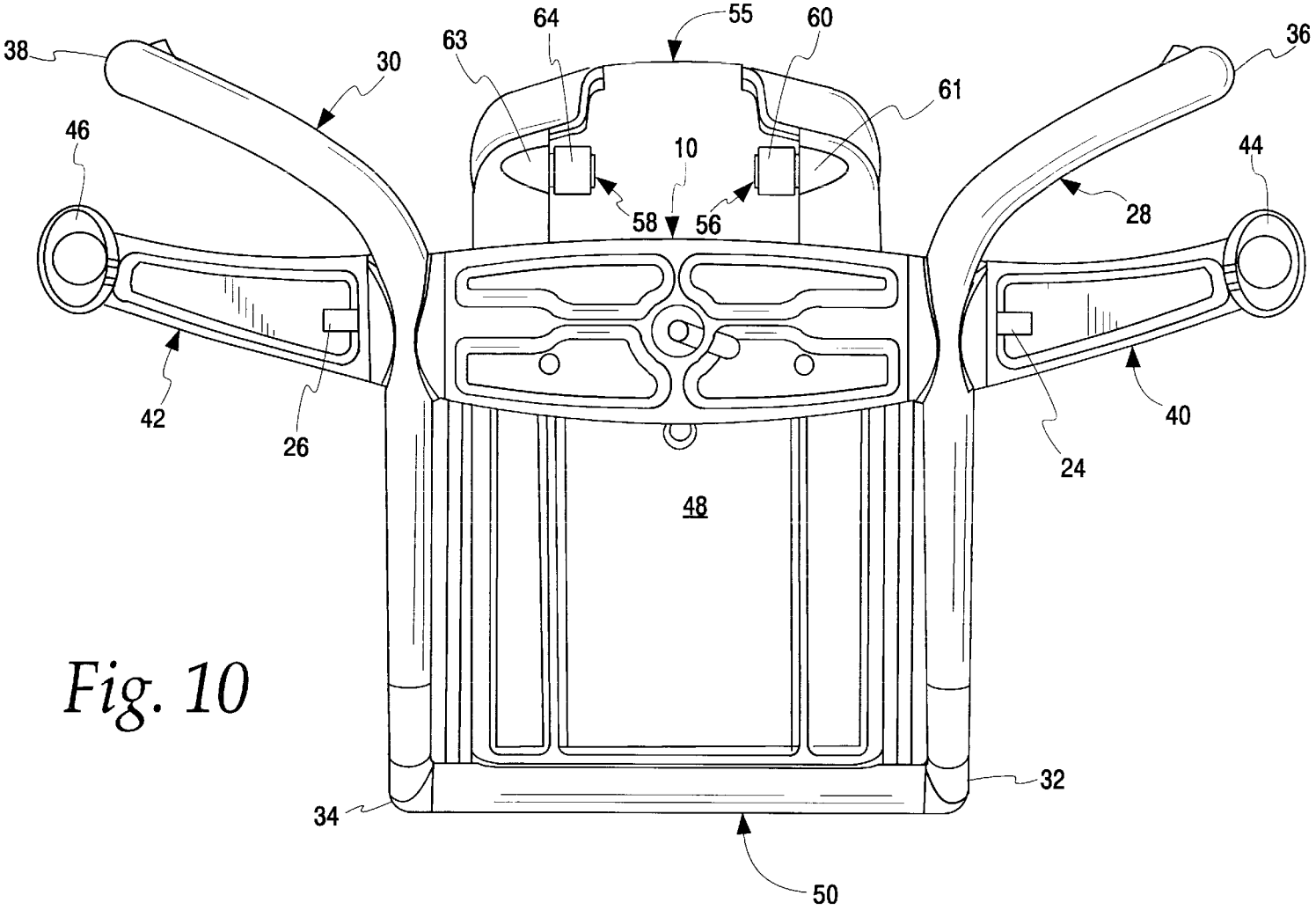
FIG. 10 is a bottom view of the combined modules illustrated in FIG. 8.
Figure 11:
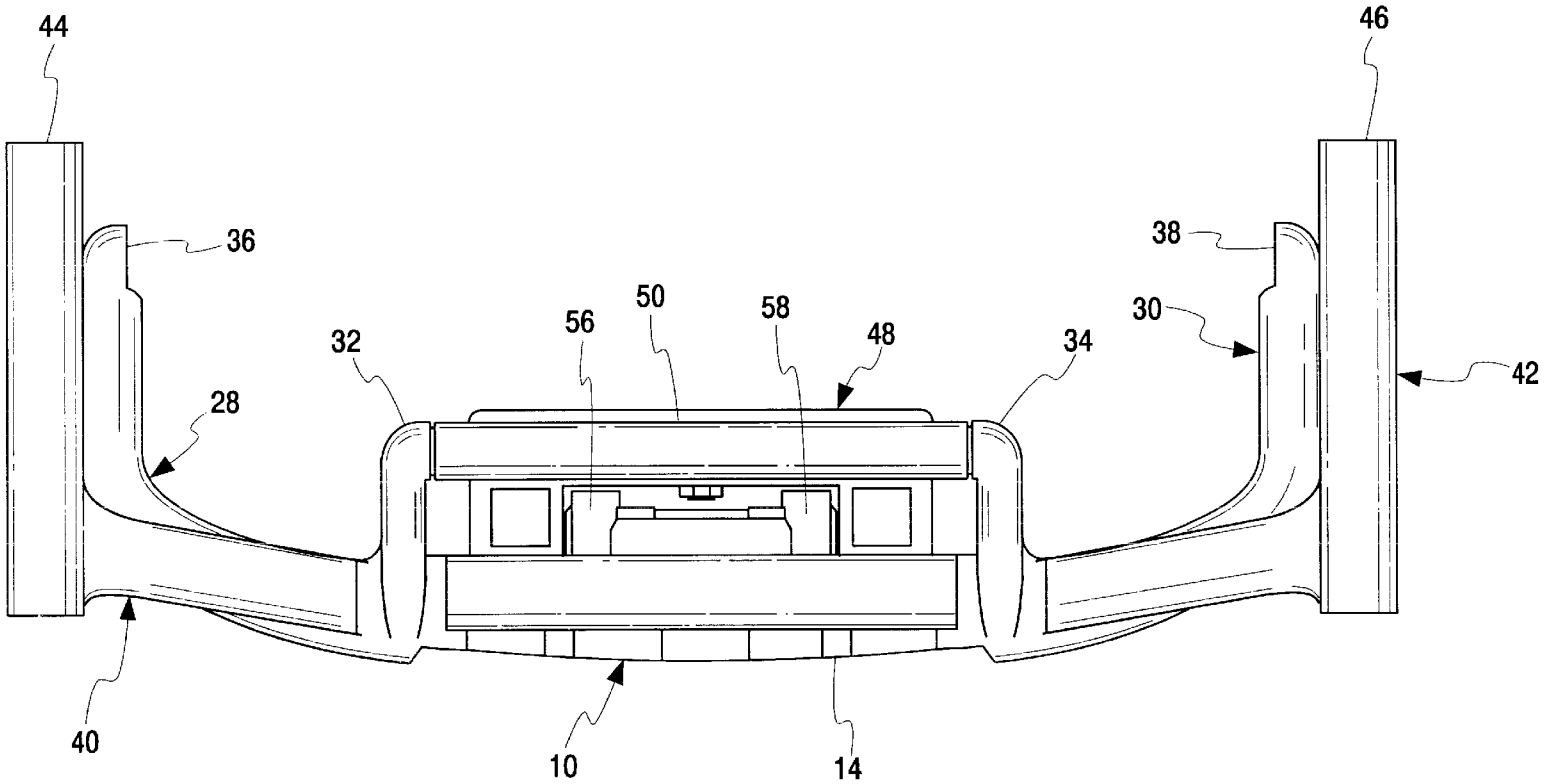
FIG. 11 is a front view of the combined modules illustrated in FIG. 8.

FIG. 9 is a back view of the combined modules illustrated in FIG. 8;

FIG. 10 is a bottom view of the combined modules shown in FIG. 8;

FIG. 11 is a front view of the combined modules illustrated in FIGS. 8–10.

Figure 12:
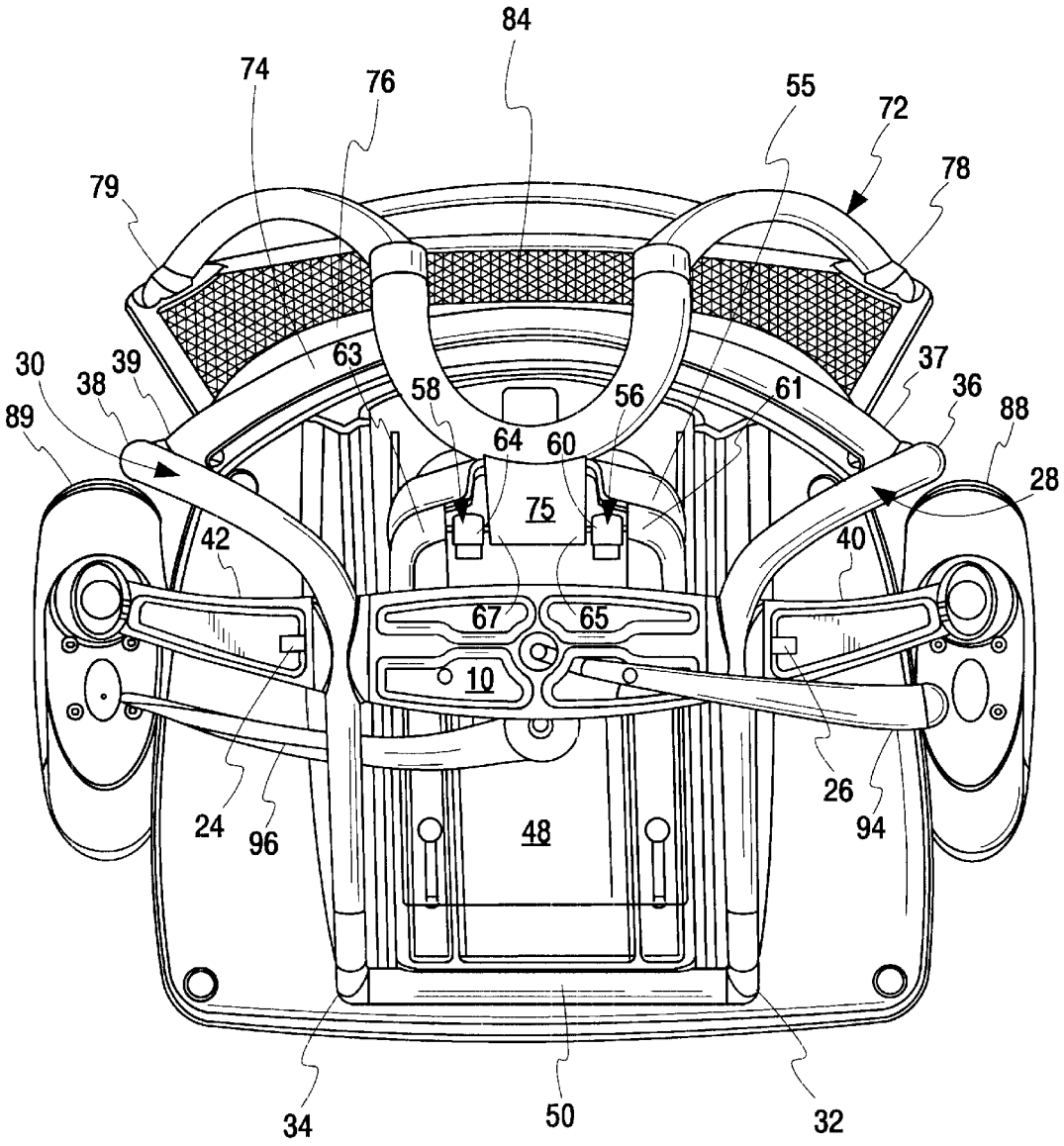
FIG. 12 is a bottom view of the combined modules of FIG. 8 with the back rest frame module and the arm rests added and with the lever arms for the seat tilt position module and the seat height adjusting module being shown.

FIG. 12 is a bottom view of a portion of the chair with the back rest frame module 72 attached to the seat and back support frame module 28, 30 and to the seat plate 48 through links 56, 58 and for receiving the back rest 84 as illustrated in FIG. 1.

As can be best seen in FIGS. 1 and 12, the back rest frame module 72 comprises upper ends 78, 79 (see FIG. 12) for receiving an upper end of the back rest 84. The back rest frame module also has a center pivot bar 74 for receiving a lower end of the back rest 84 and a lower pivot bar 75 for pivotal coupling to the rear end 55 of the seat plate 48.

It will be noted best in FIG. 12 that right and left outer end portions 37, 39 of the center pivot bar 74 of the back rest frame module 72 provide pivotal attachment to the rear end portions 36, 38 of the first and second elongated seat and back support frame modules on the sides of the central base module 10. Further, right and left mounting structures 61, 63 (see FIG. 8) on the rear end portion 55 of the seat plate 48 are pivotally coupled to right and left outer end portions 65, 67 of the lower pivot bar 75 (see FIG. 12) for pivotal coupling to the seat plate 48. The pivotal coupling comprises the first pivot link 56 (see FIG. 8) having a first end portion 60 for pivotal coupling to the right mounting structure 61 on the seat plate module 48 and a second end portion 62 for pivotal coupling to the right outer end portion 65 of the lower pivot bar 75. There is the second pivot link 58 having a first end portion 64 for pivotal coupling to the left mounting structure 63 on the seat plate 48 and a second end portion 66 for pivotal coupling to the left outer end portion 67 of the lower pivot bar 75. While the first and second links have been described, it will be obvious to one skilled in the art that a single link could be used if desired and properly fitted at both ends to the respective pivot points.

In FIG. 12, a seat back tilt control module is associated with the seat plate module 48 with a lever arm 96 attached to the tilt control module for adjusting the tilt of the seat back module. The details of this module are disclosed in commonly assigned co-pending patent application Ser. No. 09/882,500 filed Jun. 15, 2001, and entitled "Multi-Position Tilt-Limiting Mechanism." Further, as can be seen in both FIGS. 12 and 13, a lever 94 is mounted on central base module 10 and actuates a gas cylinder in the portion 93, FIG. 1, of the wheel base module 92 to control the seat height adjustment in a manner well known in the art.

Figure 13:
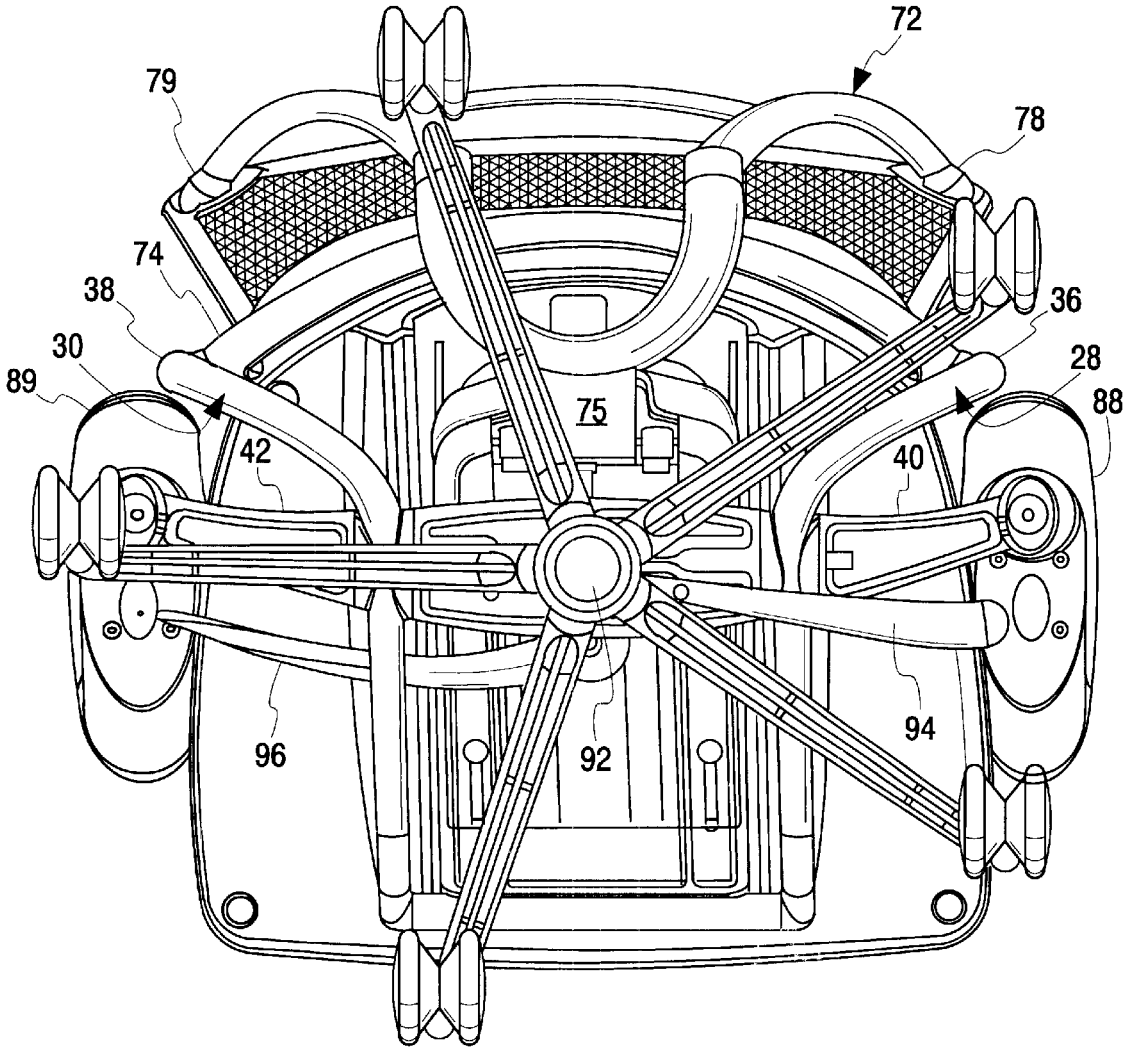
FIG. 13 is a bottom view of the chair portion of FIG. 12 with the wheel base module added.

It will also be noted in FIGS. 1 and 13 that the wheel base module 92 is coupled to the bottom portion of the central base module 10 for providing mobility to the chair.

Further, in FIG. 1 it will be noted that a lumbar support module 76 having outer portions 86 connected to the outer edge of the back rest 84 is added to the chair. The detailed description of this module is also described in commonly assigned co-pending patent application Ser. No. 09/881,795 filed Jun. 15, 2001 and entitled "Lumbar Support For A Chair."

Finally, in FIG. 13 it will be noted that arm rests 88, 89 are connected to the first and second arm rest structures 40, 42 (FIG. 6) mounted on the rods 24, 26 extending from the right and left seat and back support frame modules. The upper ends 44, 46 (see FIG. 7) of the arm rest modules are used to mount the arm rests 88, 89 (see FIG. 12). Second ends 41, 43, FIG. 6, on the arm rest modules 40, 42 provide rigid mountings on the rods 24, 26.

It will also be noted in FIG. 4 in particular that the spacing between the rear end portions 36, 38 of the right and left seat and back support frame modules 28 and 30 is greater than the spacing between the front end portions 32, 34 of the right and left seat and back support frame modules 28, 30. This enables the mounting of the seat plate 48 to the front end portion thereof and the back rest frame modules 72 to the rear end thereof as explained previously.

Thus, there has been disclosed a novel modular chair comprising a central module 10 having a top portion 12 and a bottom portion 14 and first and second end portions 16, 18. Rods 24, 26 extend outwardly from the first and second end portions 16 and 18 of the central module 10. Right and left seat and back support frame modules 28, 30, are mounted rigidly on the rods 24, 26 on each end of the central module 10 with each of the right and left seat and back support modules 28 and 30 having a front end portions 32, 34 and rear end portions 36, 38. The seat plate 48 is mounted over the top of the central module 10 for receiving the chair seat 90, the seat plate 48 having the front portion 50 and the rear portion 55. Right and left mounting structures 52, 54 and 61, 63 are on both the front portion 50 and rear portion 55 of the seat plate 48. These attach respectively the front portion of the seat plate 48 to the front end portions 32,34 of the seat and back support frame modules 28 and 30 and to the back rest frame module 72. The back rest frame module 72 has an upper end, a center pivot bar and a lower pivot bar. The center pivot bar 74 has a right end portion 37 for pivotal attachment to the rear end portion 36 of the seat and back support frame module 28 and a left end portion 39 for pivotal attachment to the rear end portion 38 of the seat and back support frame module 30. The lower pivot bar 75 on the back rest frame has right and left end portions 65, 67 for being pivotally coupled to respective right and left rear mounting structures on the seat plate 48. A wheel base structure 92 is mounted to and extends from the bottom portion of the central module 10. In addition, first and second arm rest modules 40, 42 are mounted on the rods 24, 26 on the right and left seat and back support frame modules. The first ends 44, 46 on each of said arm rest modules 40, 42 are for mounting corresponding arm rests 88, 89. The second ends 41, 43 on each of the arm rest structures is rigidly mounted on the rods 24, 26 extending from each respective right and left seat and back support frame modules 28, 30.

While the present invention has been described as in connection with a preferred embodiment thereof, it will be apparent to those skilled in the art that many changes and modifications can be made without departing from the spirit and scope of the invention. Accordingly, it is intended by the appended claims to cover all such changes and modifications encompassed by the spirit and scope of the appended claims.

What is claimed is:

1. A modular chair comprising:

a central module having a top and a bottom and right and left end portions;

a rod extending outwardly from each of said central module right and left end portions;

right and left chair support frame modules, one rigidly mounted on said rod on one end of said central module and one rigidly mounted on said rod on the other of said central module;

each of the right and left chair frame modules having a front end portion and a rear end portion;

a seat plate for receiving a chair seat, said seat plate module having a front portion and a rear portion;

right and left mounting structures on both the front and rear portions of said seat plate module;

attaching means for attaching said right and left mounting structures on the front portion of said seat plate module to the front end portion of said right and left chair support frame module;

a back rest frame module for receiving a seat back and having an upper end, a center pivot bar and a lower pivot bar;

said center pivot bar having a right end portion for pivotal attachment to said rear end portion of said right chair support frame module and a left end portion for pivotal attachment to said rear end portion of said left chair support frame module;

said lower pivot bar on said back rest frame module having right and left end portions for pivotal coupling to respective right and left rear mounting structures on said seat plate module;

a rear base structure mounted to and extending from the bottom of said central module; and at least one link having a first end and a second end for coupling said lower pivot bar on said back rest frame module to said right and left rear mounting structures on said seat plate module.

2. The chair of claim 1 wherein said at least one link comprises:

first and second spaced links, each link having a first and a second end;

first coupling means for connecting said first end of said first link to said right rear mounting structure on said seat plate module;

second coupling means for connecting said second end of said first link to said right end of said back rest frame module lower pivot bar;

third coupling means for connecting said first end of said second link to said left rear mounting structure on said seat plate module; and fourth coupling means for connecting said second end of said second link to said left end of said back rest frame module lower pivot bar.

3. A modular chair comprising:

a central module having a top and a bottom and right and left end portions;

a rod extending outwardly from each of said central module right and left end portions;

right and left chair support frame modules, one rigidly mounted on said rod on one end of said central module and one rigidly mounted on said rod on the other of said central module;

each of the right and left chair frame modules having a front end portion and a rear end portion;

a seat plate for receiving a chair seat, said seat plate module having a front portion and a rear portion;

right and left mounting structures on both the front and rear portions of said seat plate module;

attaching means for attaching said right and left mounting structures on the front portion of said seat plate module to the front end portion of said right and left chair support frame module;

a back rest frame module for receiving a seat back and having an upper end, a center pivot bar and a lower pivot bar;

said center pivot bar having a right end portion for pivotal attachment to said rear end portion of said right chair support frame module and a left end portion for pivotal attachment to said rear end portion of said left chair support frame module;

said lower pivot bar on said back rest frame module having right and left end portions for pivotal coupling to respective right and left rear mounting structures on said seat plate module;

a rear base structure mounted to and extending from the bottom of said central module;

said rod extending from each end of said center module also extending through said right and left chair support frame modules, respectively;

first and second arm rest modules for mounting on each said right and left chair support frame modules;

a first end of each of said arm rest modules for mounting an arm rest; and a second end on each of said arm rest modules for rigid support on said rod extending from each respective right and left chair support frame modules.

4. A chair of modular construction comprising:

a central base module having a top and a bottom and opposing ends;

a seat plate having a front end and a rear end for receiving a chair seat;

first and second elongated seat and back support modules, each having a front end and a rear end and each being rigidly attached to one end of said central base module, said front end supporting the front end of said seat plate;

a back rest frame module attached to said rear end of said seat and back support modules and to said rear end of said seat plate for supporting said seat plate module and for receiving a back rest;

a wheel base module coupled to the bottom of said central base module for providing mobility to said chair;

attachment means for coupling said forward end of said seat plate to said front end of each of said elongated seat and back support modules;

said back rest frame module comprising an upper end for receiving an upper end of a back rest, a center pivot bar for receiving a lower end of the back rest, and a lower pivot bar for pivotal coupling to the rear end of said seat plate;

right and left outer ends on said center pivot bar for pivotal attachment to the rear end of corresponding ones of said first and second elongated seat and back support modules on the sides of said central base module;

right and left mounting structures on the rear end of said seat plate;

right and left outer ends on said lower pivot bar for pivotal coupling to said right and left mounting structures on the rear end of said seat plate;

a first link having a first end for pivotal coupling to said right mounting structure on said seat plate module and a second end for pivotal coupling to said right outer end of said lower pivot bar; and a second link having a first end for pivotal coupling to said left mounting structure on said seat plate module and a second end for pivotal coupling to said left outer end of said lower pivot bar.

5. The chair of claim 4 further comprising:

first and second armrest modules, each module having an upper end and a lower end;

said first and second armrest modules being attached to a corresponding one of said elongated seat and back support modules on corresponding sides of said central base module;

a mounting rod extending from each end of said central base module; and said mounting rods forming a support for each of said attached elongated seat and back support modules and extending beyond said attached elongated seat and back support modules for support of said first and second arm rest modules.

6. The chair of claim 5 wherein each of said first and second arm rest modules comprises:

a first end for attaching said arm rest module to a corresponding one of said elongated seat and back support modules; and a second end for receiving an arm rest thereon.

7. A chair of modular construction comprising:

a central base module having a top and a bottom and opposing ends;

a seat plate having a front end and a rear end for receiving a chair seat;

first and second elongated seat and back support modules, each having a front end and a rear end and each being rigidly attached to one end of said central base module, said front end supporting the front end of said seat plate;

a back rest frame module attached to said rear end of said seat and back support modules and to said rear end of said seat plate for supporting said seat plate and for receiving a back rest;

a wheel base module coupled to the bottom of said central base module for providing mobility to said chair;

a seat back tilt control module associated with said seat plate module; and a lever arm attached to said tilt control module for adjusting the tilt of said seat back module.

8. A chair having exposed frame modules comprising:

a base;

a seat having a front end portion and a rear end portion located above said base;

a back rest having an upper end portion and a lower end portion and located above said base;

a seat plate having a front end portion and a rear end portion connected to said seat and located above said base;

a central frame module extending laterally and being mounted to said base and located under said seat plate;

a first seat and back support frame module connected to a lateral end portion of said central frame module, said first seat and back support frame module being integral and having a generally L-shape with a forward extending arm having a front end portion and a rearward extending arm flaring outwardly and upwardly and having a rear end portion;

a second seat and back support frame module connected to another lateral end portion of said central frame module, said second seat and back support frame module being integral and having a generally L-shape with a forward extending arm having a front end portion and a rearward extending arm flaring outwardly and upwardly and having a rear end portion, said second seat and back support frame module being generally a mirror image of said first seat and back support frame module;

the front end portions of said forward extending arms of said first and said second seat and back support frame modules being pivotally attached to the front end portion of said seat plate;

a link having a first end portion and a second end portion, the first portion of said link being pivotally attached to the rear end portion of said seat plate; and a back rest frame module having a generally L-shape having an upper end portion attached to the upper end portion of said back rest, a mid portion attached to the lower end portion of said back rest and pivotally attached to the rear end portions of said first and said second seat and back support frame modules, and a lower portion and pivotally attached to the second end portion of said link.

9. The chair as claimed in claim 8 including:

a lumbar support module.

10. The chair as claimed in claim 8 including first and second armrest modules mounted to said first and said second seat and back support frame modules.

11. The chair as claimed in claim 8 wherein:

the upper end portion of said back rest frame module includes two upwardly extending and diverging arms.

12. The chair as claimed in claim 11 including:

a lumbar support module; and first and second armrest modules mounted to said first and said second seat and back support frame modules.

13. A chair having exposed frame modules comprising:

a base;

a seat having a front end portion and a rear end portion located above said base;

a back rest having an upper end portion and a lower end portion and located above said base;

a central frame module extending laterally and being mounted to said base;

a first seat and back support frame module connected to a lateral end portion of said central frame module, said first seat and back support frame module being integral and having a generally L-shape with a forward extending arm having a front end portion and a rearward extending arm flaring outwardly and upwardly and having a rear end portion, a second seat and back support frame module connected to another lateral end portion of said central frame module, said second seat and back support frame module being integral and having a generally L-shape with a forward extending arm having a front end portion and a rearward extending arm flaring outwardly and upwardly and having a rear end portion, said second seat and back support frame module being generally a mirror image of said first seat and back support frame module;

the front end portions of said forward extending arms of said first and said second seat and back support frame modules being pivotally connected to said seat; and a back rest frame module having a generally L-shape having an upper end portion attached to the upper end portion of said back rest, a mid portion attached to the lower end portion of said back rest and pivotally attached to the rear end portions of said first and said second seat and back support frame modules, and a lower portion and pivotally connected to said seat.

14. The chair as claimed in claim 13 including:

a seat plate having front and rear end portions, said seat plate being connected to said seat.

15. The chair as claimed in claim 14 including:

a link having first and second end portions, the first end portion being pivotally attached to said seat plate, and the second end portion being pivotally attached to the lower portion which slides relative to the seat plate.

* * * * *